US006485316B1

(12) United States Patent
Chen

(10) Patent No.: US 6,485,316 B1
(45) Date of Patent: Nov. 26, 2002

(54) CONNECTOR SECURING DEVICE

(75) Inventor: Yun-Lung Chen, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/174,275

(22) Filed: Jun. 17, 2002

(30) Foreign Application Priority Data

Apr. 30, 2002 (TW) ..... 091205972

(51) Int. Cl.[7] ..... H01R 13/44

(52) U.S. Cl. ..... 439/135; 439/373; 439/133; 439/369

(58) Field of Search ..... 439/133, 134, 439/135, 369, 373

(56) References Cited

U.S. PATENT DOCUMENTS 4,083,618 A * 4/1978 Busch, Jr. ..... 174/67
4,789,353 A * 12/1988 Busta et al. ..... 439/373
5,011,427 A * 4/1991 Martin ..... 439/373
5,288,241 A * 2/1994 Davidge et al. ..... 439/133
5,507,664 A * 4/1996 Carmo ..... 439/369
5,575,677 A * 11/1996 Buckner et al. ..... 439/147
6,196,859 B1 * 3/2001 Garlarza ..... 439/369

* cited by examiner

*Primary Examiner*—Tho D. Ta
(74) *Attorney, Agent, or Firm*—Wei Te Chung

(57) ABSTRACT

A connector securing device in accordance with one embodiment includes a panel (50) and a housing (10). The panel defines an opening (54). The housing perpendicularly extends from the panel at the opening. The housing includes a bottom wall (12), a top wall (14), and an end wall (16). The bottom wall, top wall and end wall cooperatively define a cavity (17) for receiving a connector (80) therein. The end wall defines a through hole (162), for extension of a cable (82) of the connector therethrough. A connector securing device in accordance with another embodiment further includes a plurality of locking tabs (40) integrally extend outwardly from middle portions of a plurality of end walls (322, 342, 382). A plurality of connectors received in the housing (30) cannot be released from the cavity (37) when the locking tabs are locked together by a padlock (46).

3 Claims, 7 Drawing Sheets

CONNECTOR SECURING DEVICE

BACKGROUND OF THE INVENTION

1. Field of the Invention

The present invention relates to a securing device, and particularly to a connector securing device which can protect a connector from accidental detachment from a complementary mating connector.

2. Description of Related Art

Conventionally, a first connector for transmitting communication signals is directly plugged into a complementary mating connector without any securing or protection device to protect the first connector from accidental detachment from the mating connector. When a cable of the first connector is inadvertently pulled or dragged, the first connector can easily detach from the mating connector and cause interruption of signals.

To solve the above problem, various forms of latching or retention devices are adopted to secure a first connector to its complementary mating connector. Retention devices vary widely. They range from integral latches on the first connector itself to separate threaded or screw members that secure the first connector to the mating connector and/or a panel. Taiwan Patent Application No. 379864 discloses a conventional connector securing device. The connector comprises two sleeves. A pair of jackscrews are rotatably mounted in the sleeves respectively. A complementary mating connector comprises two jackscrew nuts corresponding to the jack screws. Threaded distal ends of the jackscrews are threadedly received in the corresponding jackscrew nuts. Thus the first connector is fixedly secured to the mating connector.

However, this connector securing device adds extra components and structures to the connectors. Manufacturing of the connectors is more complicated. All these factors increase the cost of the connectors.

Therefore, a connector securing device which overcomes the above-mentioned problems is strongly desired. A copending application with an unknown serial number filed on Jun. 14, 2002, titled "CONNECTOR SECURING DEVICE" with the same applicant and the same assignee as the instant invention, discloses an approach.

SUMMARY OF THE INVENTION

Accordingly, an object of the present invention is to provide a low-cost connector securing device having a simple structure which can effectively protect a connector from accidental detachment from its mating connector.

In order to achieve the above object, a connector securing device in accordance with a preferred embodiment of the present invention comprises a panel and a housing. The panel defines an opening. The housing perpendicularly extends from the panel at the opening. The housing comprises a bottom wall, a top wall, and an end wall. The bottom wall, top wall and end wall cooperatively define a cavity for receiving a connector therein. The end wall defines a through hole, for extension of a cable of the connector therethrough. A connector securing device in accordance with a further alternative embodiment of the present invention further comprises a plurality of locking tabs integrally extending outwardly from middle portions of a plurality of end walls. A plurality of connectors received in the housing cannot be released from the cavity when the locking tabs are locked together by a padlock.

Other objects, advantages and novel features of the present invention will become more apparent from the following detailed description when taken in conjunction with the accompanying drawings, in which:

DETAILED DESCRIPTION OF THE INVENTION

Figure 1:
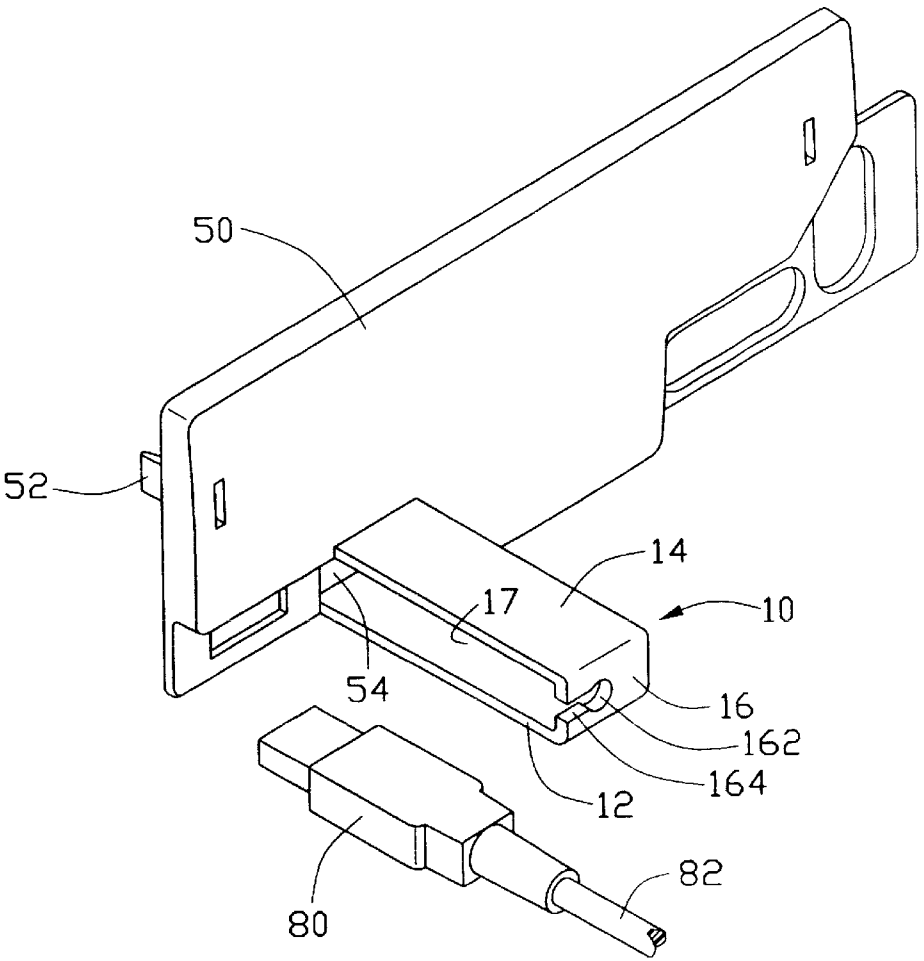
FIG. 1 is an isometric view of a connector securing device in accordance with a preferred embodiment of the present invention, together with a connector ready for attachment to the connector securing device.

Referring to FIG. 1, a connector securing device in accordance with a preferred embodiment of the present invention comprises a panel 50 and a housing 10.

The panel 50 comprises a pair of latches 52 for firmly securing the panel 50 to a fixed panel (not shown). The fixed panel comprises a complementary mating connector (not shown). An opening 54 is defined in the panel 50.

The housing 10 perpendicularly extends from the panel 50 at the opening 54. The housing 10 comprises a bottom wall 12, a top wall 14, and an end wall 16. The bottom wall 12, top wall 14 and end wall 16 cooperatively define a cavity 17 therebetween, for receiving a connector 80 therein. The cavity 17 is in communication with the opening 54 of the panel 50. The end wall 16 defines a through hole 162, for extension of a cable 82 of the connector 80 therethrough. A cutout 164 is defined in the end wall 16, between a free side of the end wall 16 and the through hole 162. The cable 82 is passed through the cutout 164 to be secured in the through hole 162.

Figure 2:
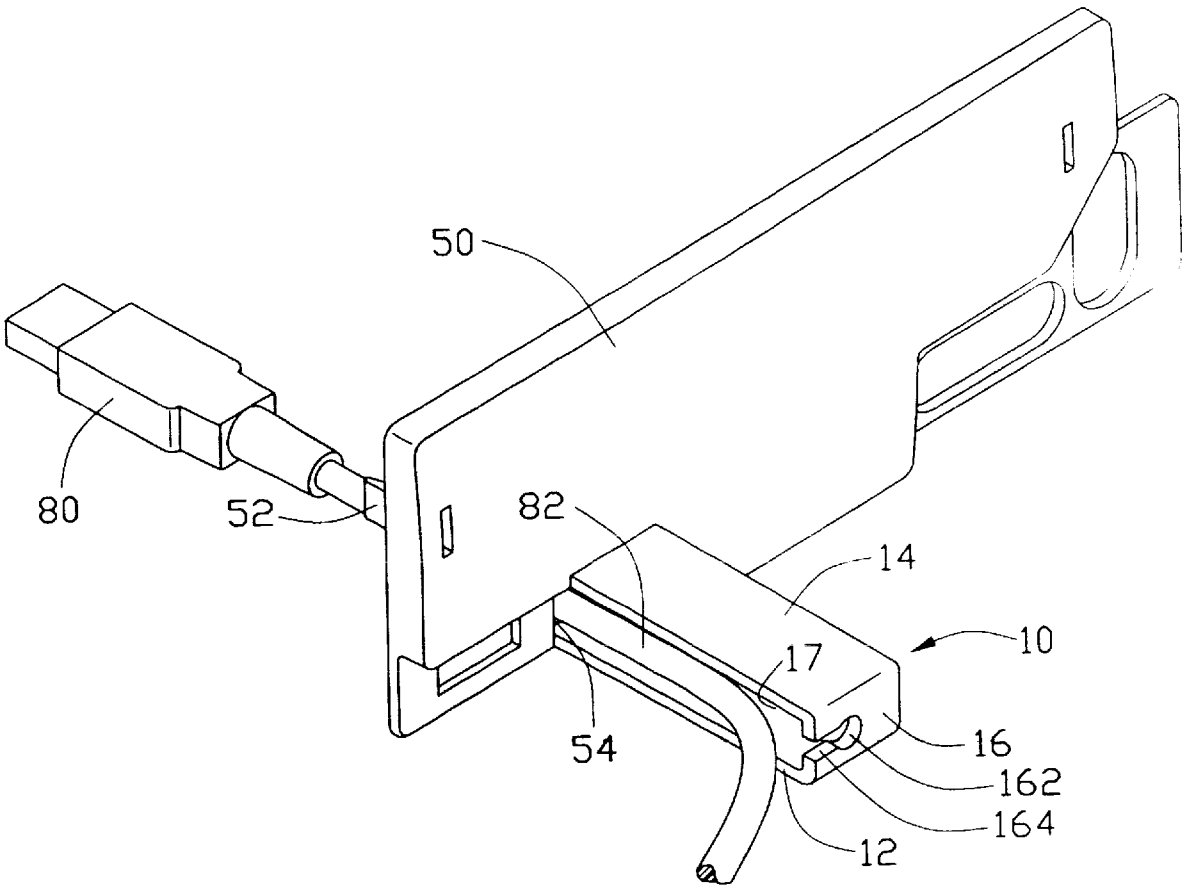
FIG. 2 is a partly assembled view of FIG. 1.
Figure 3:
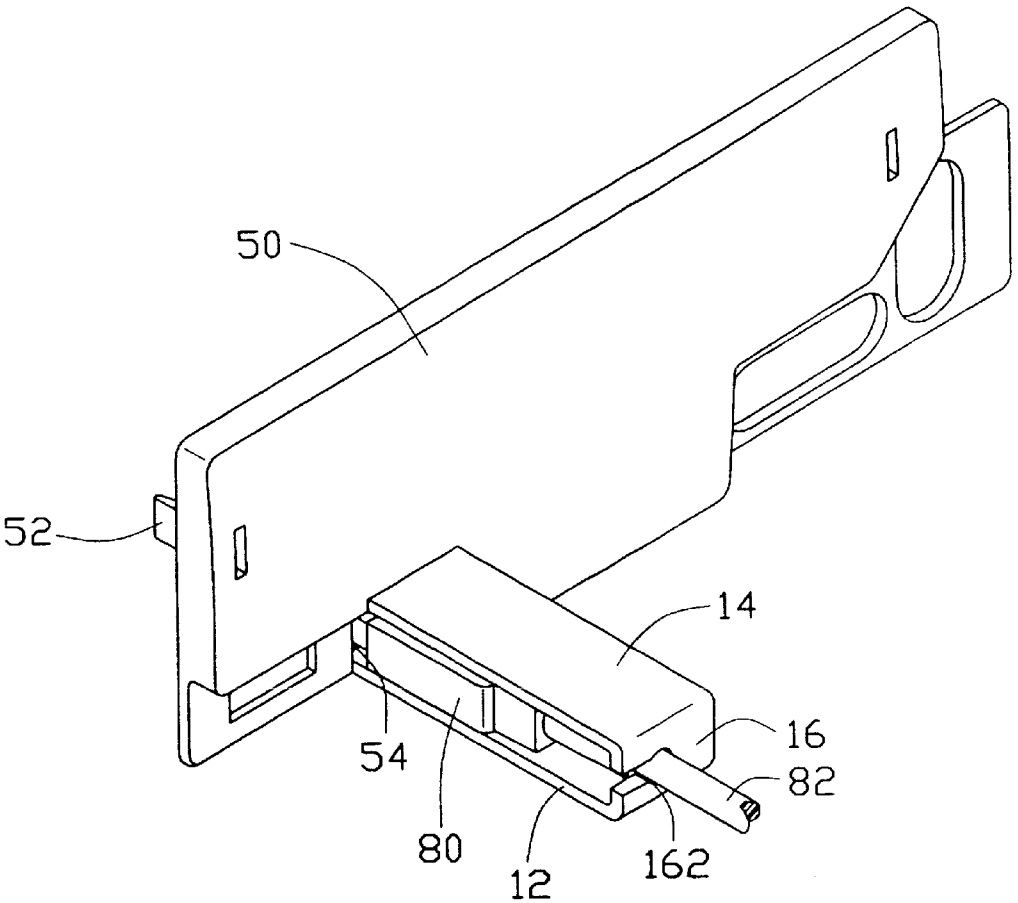
FIG. 3 is a fully assembled view of FIG. 1.

Referring to FIGS. 2–3, in use, the connector 80 is put into the cavity 17 of the housing 10. The connector 80 is pulled out through the opening 54 of the panel 50 (see FIG. 2). The connector 80 is plugged into the complementary mating connector of the fixed panel (not shown). The panel 50 is then pushed toward the fixed panel, with the panel 50 sliding along the cable 82 of the connector 80. The latches 52 of the panel 50 engage with the fixed panel, thereby securing the panel 50 to the fixed panel. The connector 80 is thus fittingly received in the cavity 17 of the housing 10. The cable 82 is pushed through the cutout 164 of the end wall 16 of the housing 10, and secured in the through hole 162 of the end wall 16. Thus, the connector 80 is firmly secured in the housing 10, and protected from accidental detachment from the complementary mating connector (see FIG. 3).

Figure 4:
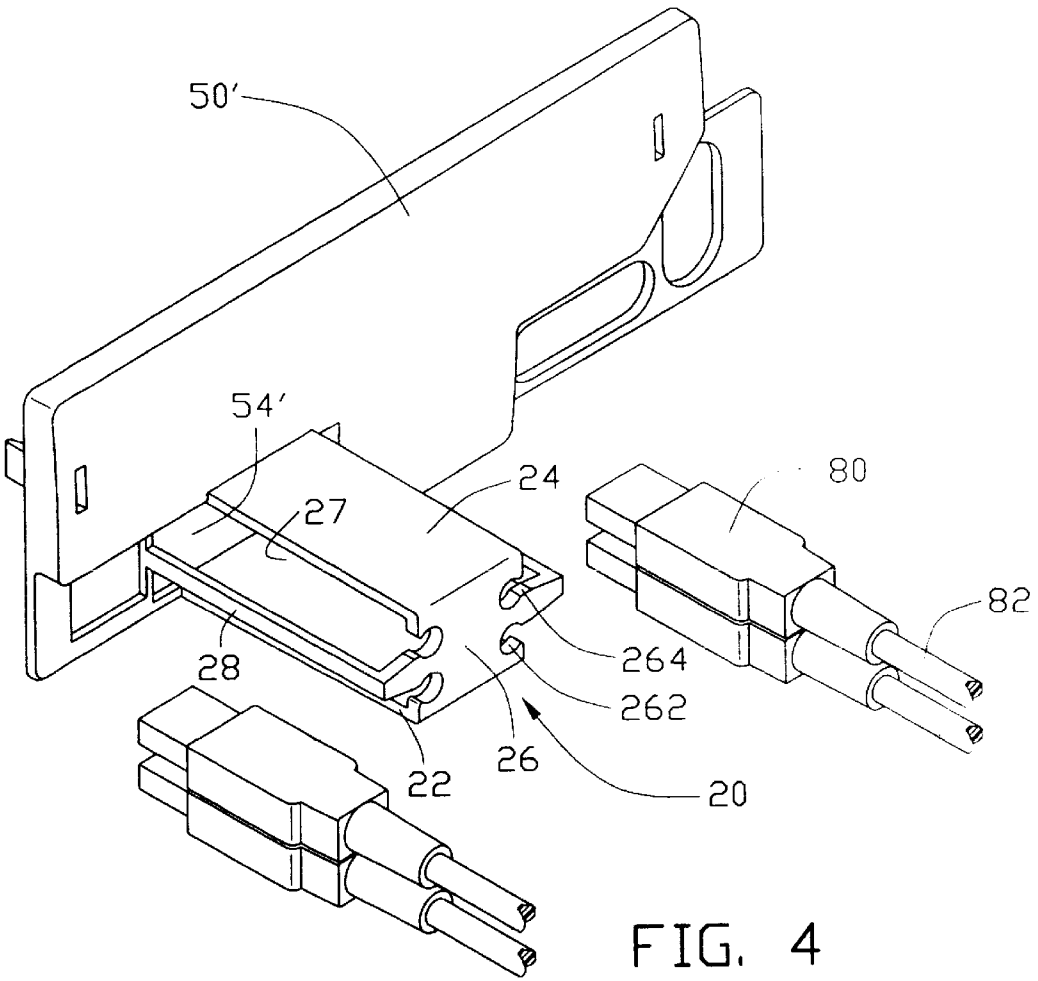
FIG. 4 is an isometric view of a connector securing device in accordance with an alternative embodiment of the present invention, together with two pairs of connectors ready for attachment to the connector securing device.

FIG. 4 shows a connector securing device in accordance with an alternative embodiment of the present invention. A housing 20 perpendicularly extends from a panel 50' at an opening 54' of the panel 50'. The housing 20 comprises a bottom wall 22, a top wall 24, an end wall 26, and a pair of arms 28. The arms 28 are generally disposed midway between the bottom and. top walls 22, 24, and are parallel to the bottom and top walls 22, 24. Each arm 28 is generally L-shaped, with the arms 28 symmetrically opposing each other. Proximal ends of the arms 28 integrally connect with the panel 50' at opposite sides of the opening 54' respectively. Distal ends of the arms 28 integrally connect with opposite sides respectively of a middle portion of the end wall 26 of the housing 20, for strengthening the housing 20. The bottom, top, and end walls 22, 24, 26 and the arms 28 cooperatively define a cavity 27 therebetween, for receiving four connectors 80 therein. The end wall 26 symmetrically defines four through holes 262, for respective extension of four cables 82 of the connectors 80 therethrough. Four cutouts 264 are defined in the end wall 26, between opposite free sides of the end wall 26 and the respective through holes 262. The cables 82 are passed through the cutouts 264 to be secured in the through holes 262. In further variations of the alternative embodiment, the numbers of arms 28 of the housing 20 may be increased, thus enlarging the cavity 27 and allowing more connectors 80 to be received in the housing 20. The opening 54' of the panel 50' is correspondingly enlarged.

Figure 5:
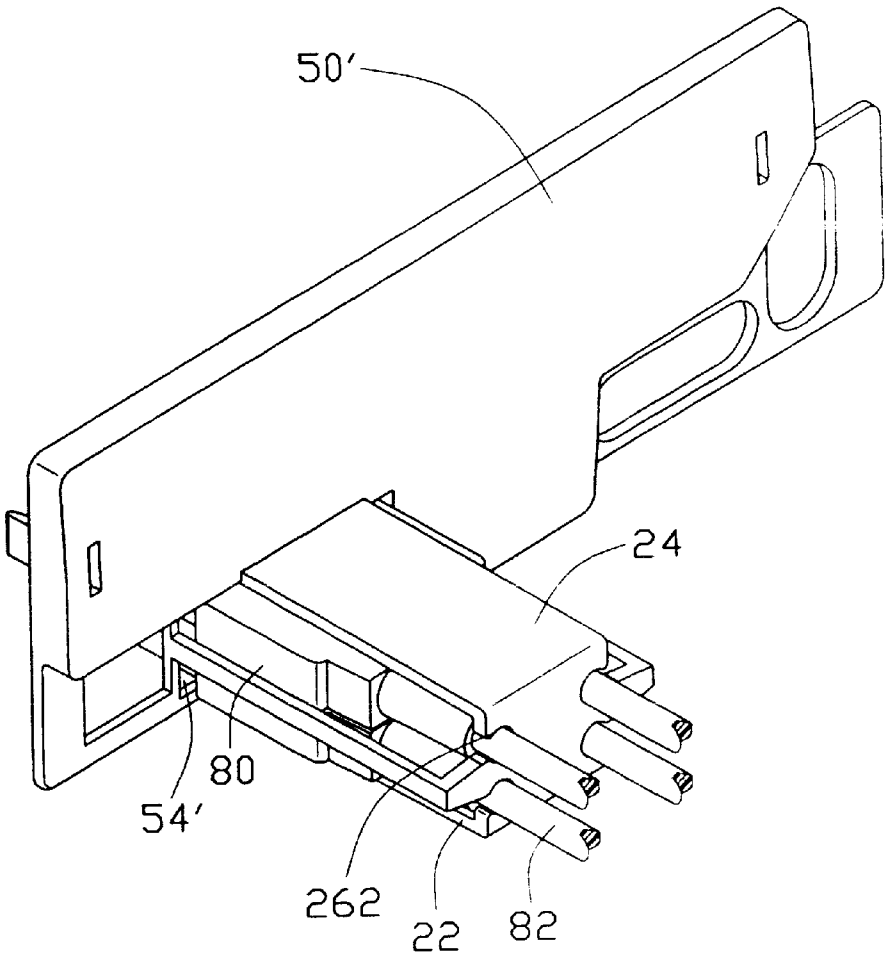
FIG. 5 is a fully assembled view of FIG. 4.

Use of the connector securing device of the alternative embodiment is similar to use of the connector securing device of the preferred embodiment. Reference is made to the above detailed description of use of the connector securing device of the preferred embodiment, with due alteration of details. FIG. 5 shows the four connectors 80 firmly secured in the housing 20.

Figure 6:
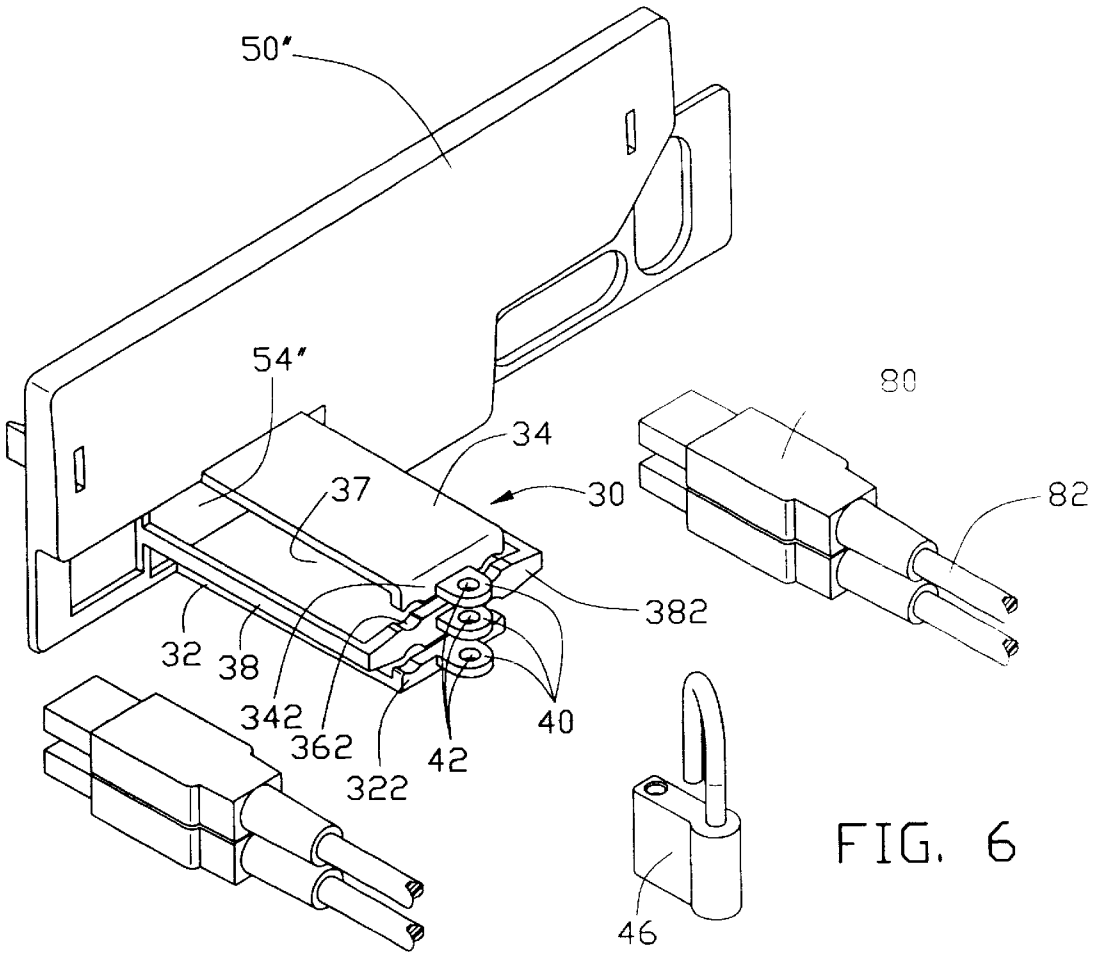
FIG. 6 is an isometric view of a connector securing device in accordance with a further alternative embodiment of the present invention, together with two pairs of connectors and a padlock ready for attachment to the connector securing device.

FIG. 6 shows a connector securing device in accordance with a further alternative embodiment of the present invention. A housing 30 perpendicularly extends from a panel 50" at an opening 54" of the panel 50". The housing 30 comprises a bottom wall 32, a top wall 34, and a frame 38 formed between the bottom and top walls 32, 34. An end wall 322 is upwardly formed from a rear of the bottom wall 32. An end wall 342 is downwardly formed from a rear of the top wall 34. The frame 38 is generally U-shaped, and is parallel to the bottom and top walls 32, 34. Proximal ends of the frame 38 integrally connect with the panel 50" at opposite sides of the opening 54" respectively. The frame 38 has an end wall 382 coplanar with the end walls 322, 342. The bottom and top walls 32, 34 and the frame 38 cooperatively define a cavity 37 therebetween, for receiving four connectors 80 therein. The end walls 322, 342, 382 are cut out to cooperatively symmetrically define four through holes 362, for respective extension of four cables 82 of the connectors 80 therethrough. Three locking tabs 40 integrally extend outwardly from middle portions of the end walls 322, 343, 382 respectively. The locking tabs 40 are parallel to each other, and each locking tab 40 defines a locking hole 42. The connectors 80 cannot be released from the cavity 37 when the locking tabs 40 are locked together by a padlock 46 (see FIG. 7).

Figure 7:
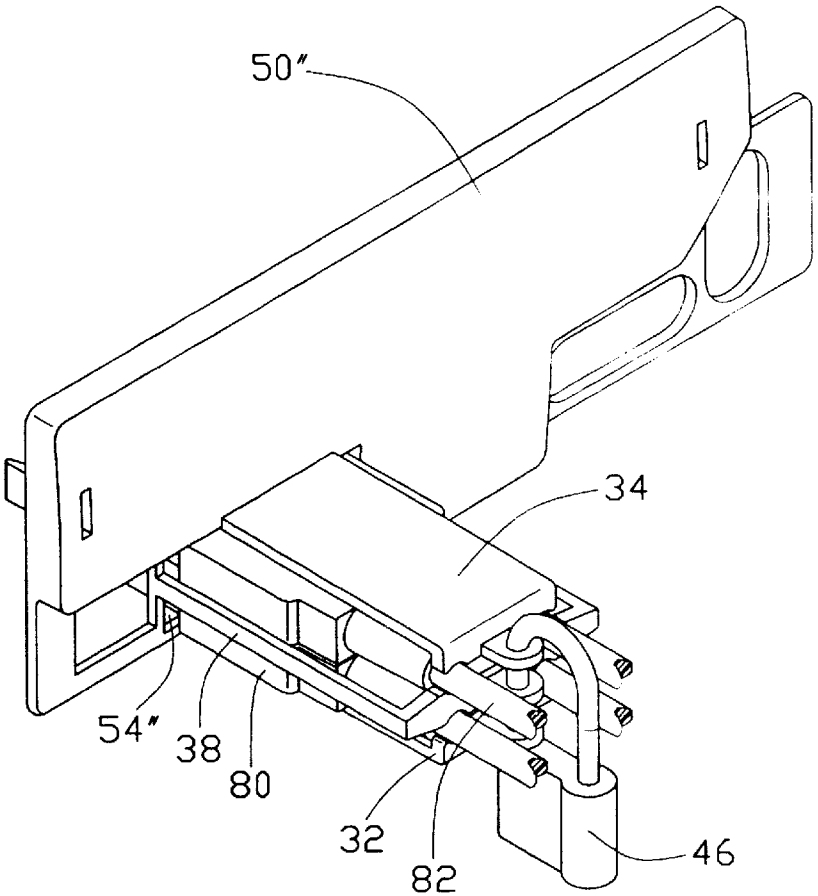
FIG. 7 is a fully assembled view of FIG. 6.

Use of the connector securing device of the further alternative embodiment is similar to use of the connector securing device of the preferred embodiment. Reference is made to the above detailed description of use of the connector securing device of the preferred embodiment, with due alteration of details. FIG. 7 shows the four connectors 80 firmly secured in the housing 30.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A connector securing device, comprising:

a panel defining an opening; and a housing arranged generally perpendicular to the panel at the opening of the panel, the housing defining a cavity for receiving at least one connector therein, wherein the panel comprises a pair of latches for fixing the panel to a fixed panel;

wherein the housing comprises a bottom wall, a top wall and an end wall, the bottom wall, top wall and end wall cooperatively defining the cavity;

wherein the housing further comprises a pair of generally L-shaped arms;

wherein ends of the arms respectively connect with the panel at opposite sides of the opening, and opposite ends of the arms respectively connect with opposite sides of the end wall of the housing;

wherein the end wall of the housing defines at least one hole.

2. A connector securing device, comprising:

a panel defining an opening; and a housing extending from the panel at the opening of the panel, the housing comprising a bottom wall, a top wall and an end wall, the bottom wall, top wall and end wall cooperatively defining a cavity for receiving at least one connector therein;

wherein an end wall is upwardly arranged at the bottom wall of the housing;

wherein an end wall is downwardly arranged at the top wall of the housing;

wherein the frame of the housing is generally U-shaped, and opposite ends of the frame respectively connect with the panel at opposite sides of the opening;

wherein the frame of the housing comprises an end wall substantially coplanar with the end walls arranged at the bottom and top walls;

wherein the end walls of the bottom wall, the top wall and the frame cooperatively symmetrically define a plurality of holes;

wherein a plurality of locking tabs is outwardly arranged at the end walls of at least two of the bottom wall, the top wall and the frame;

wherein each of the locking tabs defines a locking hole.

3. The connector securing device as described in claim 2, wherein at least one cutout is defined in the end wall of the housing, between at least one side of the end wall and the at least one hole.

* * * * *